United States Patent [19]

Easton et al.

[11] Patent Number: 4,975,009

[45] Date of Patent: Dec. 4, 1990

[54] BOLT AND WEDGE ASSEMBLY FOR PANEL UNITS

[76] Inventors: John T. Easton, 15073 Marl Dr.; Harry Harden, 15063 Marl Dr., both of Linden, Mich. 48451

[21] Appl. No.: 356,254

[22] Filed: May 24, 1989

[51] Int. Cl.[5] ..... F16B 19/00; E04G 9/00

[52] U.S. Cl. ..... 411/354; 411/347; 249/45; 249/192

[58] Field of Search ..... 249/45, 46, 47, 191, 249/196, 192; 52/127.11, 231, 584, 793, 807; 411/354, 355, 347, 348, 424, 918, 513, 516; 403/374, 405.1, 408.1, 409.1

[56] References Cited

U.S. PATENT DOCUMENTS

| | | | |
|---|---|---|---|
| 939,933 | 11/1909 | Trautner | 411/424 X |
| 3,447,771 | 6/1969 | Trimmer | 249/192 |
| 3,862,737 | 1/1975 | Fuston, Jr. | 249/196 |
| 4,194,717 | 3/1980 | Easton et al. | 249/192 |
| 4,210,305 | 7/1980 | Williams | 249/192 X |
| 4,221,357 | 9/1980 | Bowden et al. | 249/45 X |
| 4,526,396 | 7/1985 | Mayer | 411/348 X |
| 4,553,890 | 11/1985 | Gulistan | 411/347 X |
| 4,759,671 | 7/1988 | Duran | 411/347 |
| 4,776,557 | 10/1988 | Turner | 249/192 X |
| 4,846,615 | 7/1989 | Forsyth | 411/354 X |

*Primary Examiner*—Gary L. Smith
*Assistant Examiner*—Suzanne L. Dino
*Attorney, Agent, or Firm*—William D. Blackman; Arnold S. Weintraub

[57] ABSTRACT

A wedge and bolt assembly serves to temporarily connect two prefabricated panel units for use in assembling a concrete wall form. A bolt support member is mountable on a prefabricated panel, and includes a first hollow passage formed therethrough to slidingly receive a bolt. The bolt has a main body portion with two recesses formed therein to receive an engaging member. The bolt also has a projecting end with a transverse slot formed therethrough for receiving a wedge after insertion through extending flanges of aligned panel units. The bolt support member includes a second hollow passage formed therein transverse to the first hollow passage in which an engaging member is disposed, the engaging member being biased into the recesses of the bolt by a coil spring or the like. A set screw or the like is inserted in the second passageway of the bolt support member to retain the spring and engaging member therewithin.

7 Claims, 1 Drawing Sheet

BOLT AND WEDGE ASSEMBLY FOR PANEL UNITS

BACKGROUND OF THE INVENTION

1. Field of the Invention

The present invention relates to retainers for holding together concrete wall forms of panel unit type. More particularly, the present invention relates to a bolt and wedge assembly in which the bolt is disposed within a support member resists slidable movement of the bolt, and the position of the bolt is disengagably fixable.

2. Prior Art

Concrete wall forms are in common usage in the art for forming pourable concrete walls. Such concrete wall forms normally have transverse flanges extending outwardly thereform for alignment with adjacent wall forms.

In the construction industy, in order to pour concrete walls, it is common to use modular wall from panel units and to connect several of these units together temporarily as a template to pour a concrete wall. Trimmer, U.S. Pat. No. 3,447,771, discloses a reinforcement for concrete wall form connectors in which reinforcing plates are placed on tranverse flanges of prefabricated panels, allowing the panels to be fixedly attached to one another in preparatiion to form a concrete wall. Alignable apertures are formed within these plates and a pin member fits in the aligned apertures to fix them in an aligned relationship. The pin member has a slot formed transversely therein and a wedge is insertable in the slot to retain two prefabricated panels in an aligned configuration.

U.S. Pat. No. 4,194,717 was issued to the present inventors for a wedge and bolt assembly for panel units, and discloses a blot assembly which is attached to a first prefabricated panel by a bolt support, which slidably supports the bolt. A single annular groove is provided around the circumference of the bolt to accept a wedge therein and to fix the bolt in a retracted position for disassembly or storage of the panel unit when a wall is completed. The disclosure of U.S. Pat. No. 4,194,717 is here incorporated by reference.

However, the wedge and bolt assembly of applicant's prior patent still has some limitations, since it is time consuming and inconvenient for a worker to align the wedge with the annular groove when the bolt is in a retracted position, and to hammer the wedge into position.

SUMMARY OF THE INVENTION

The present invention provides an improved wedge and bolt assembly for connecting a first prefabricated panel to a second prefabricated panel wherein the first prefabricated panel has a first flange extending outwardly therefrom with a first aperture formed therethrough, and the second panel has a second flange extending outwardly therefrom with a second aperture formed therethrough which is alignable with the first aperture. A bolt and wedge assembly in accordance with the present invention, in a particular embodiment thereof, comprises:

(a) a bolt having a projecting end with a transverse slot formed therethrough, an intermediate enlarged diameter portion adjacent the projecting end for limiting translation of the bolt in the flanges, a main body portion extending from the intermediate portion and having at least two recesses formed therein for alternately receiving an engaging member;

(b) a bolt support member comprising:

(1) a support body having a first hollow passage formed therethrough for slidably receiving the bolt, the bolt support member being mountable on the first or second prefabricated panel, the support body having a second hollow passage formed therein which is substantially transverse to the first hollow passage and communicates therewith;

(2) an engaing member disposed in the second hollow passage and dimensioned to fit within either of the recesses of the main body portion;

(3) means for biasing the engaging member toward the first passage; and (4) means for preventing passage of the engaging member and the biasing means outwardly from the second passage in a direction away from the first passage; and (c) a wedge dimensioned to fit within the slot in the projecting end of the bolt.

For a more complete understanding of the present invention, the reader is referred to the following detailed description which should be read in conjunction with the accompanying drawings. Throughout the following description and in the drawings, identical reference numbers are used to refer to the same component shown in multiple figures of the drawings, in which:

DETAILED DESCRIPTION OF THE PREFERRED EMBODIMENT

In constructing a wall from assembly in preparation to pour concrete to form a wall, a number of prefabricated panel units are joined together in an edge-to-edge relationship to create the wall form assembly. Each such panel unit could have a wedge and bolt assembly in accordance with the present invention thereon to construct a wall form assembly contemplated by the present invention. The wedge and bolt assembly hereof is conceived as a a removable assembly so that it is easily serviced or replaced in the field.

Figure 1:
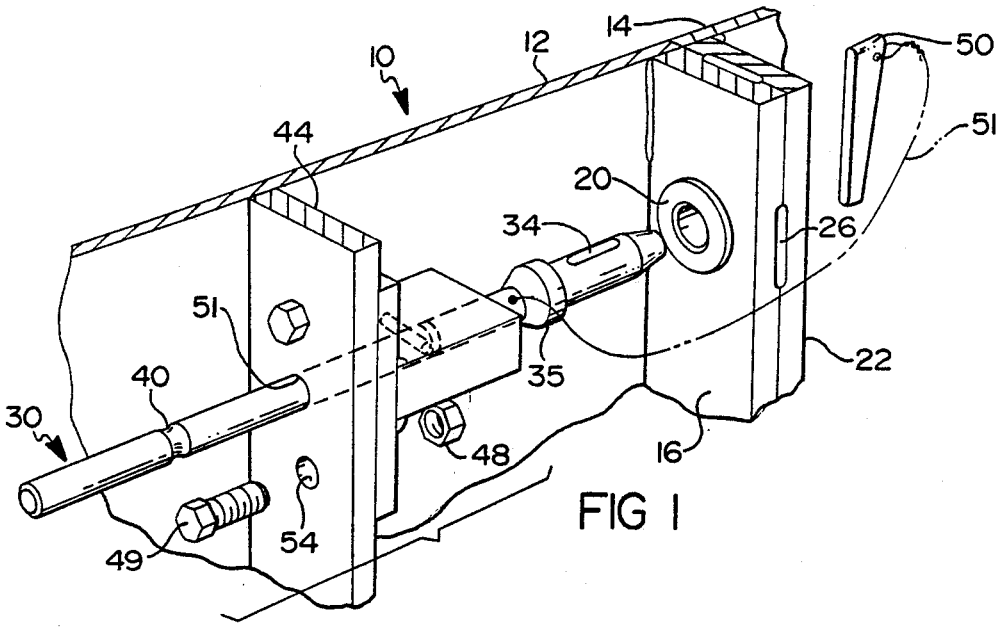
FIG. 1 is a perspective view of a wedge and bolt assembly in accordance with the present invention.

Referring FIG. 1 of the drawings, a wall form assembly is partially shown in cutaway at 10, which includes a plurality of prefabricated panel units joined together two of such panel units 12, 14 being shown. A first prefabricated panel 12 has a first flange 16 extending outwardly therefrom, with a first aperture 18 formed therethough to receive a reinforcement bushing 20 therein, through which a bolt 30 may pass. A second prefabricated panel 14 has a second flange 22 extending transversely outwardly therefrom, and the second flange 22 has a second aperture 24 formed therein to allow passage therethrough of a bolt 30. The first and second apertures 18, 24 are alignable when the panel units 12, 14 are brought into an edge-to-edge relationship as shown in FIG. 1. The first and second flanges 16, 22 may have a cutaway portion or spacing 26 formed therebetween to accomodate a tie rod assembly (not shown) for joining the wall form assembly 10 to a second wall form assembly (not shown) to create a suitable measured space therebetween for filling with concrete to form a concrete wall. Tie rod assemblies are well known to those skilled in the art. The reinforcement bushing 20 is a generally cylindrical hollow member 27 with a transverse collar 28 attached thereto. The reinforcement bushing 20 serves to prolong the life of the first panel 12 under abusive handling. The second flange 22 may also have a reinforcement bushing 20 disposed in the second aperture 24 therein.

Figure 2:
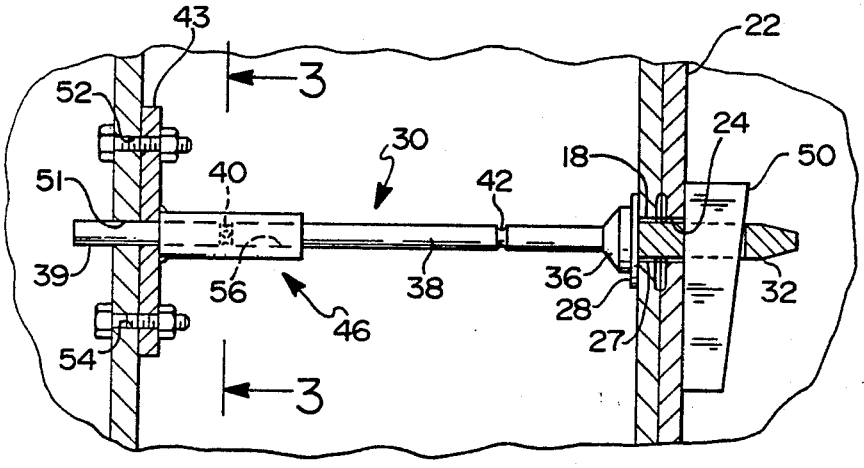
FIG. 2 is a cross section view of the assembly of FIG. 1.
Figure 3:
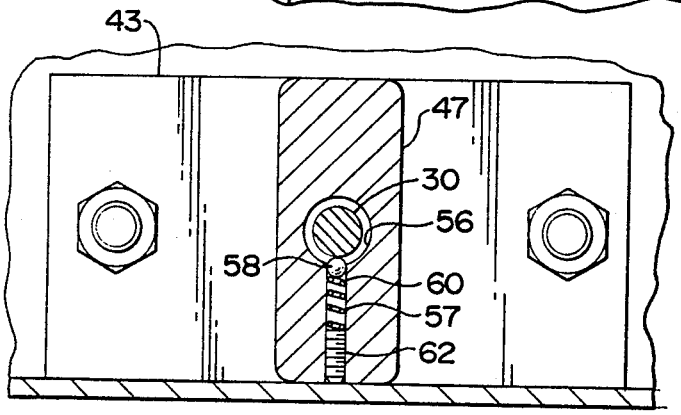
FIG. 3 is a side plan view partially in cross section, of the bolt support member, taken along the line 3–3 of FIG. 2.

As illustrated in the drawings, the bolt 30 has a projecting end 32 with a transverse slot 34 formed therethrough, for receiving a wedge 50 therethrough, as will be further described herein. The front of the projecting end 32 is formed with a conical shape to facilitate alignment thereof in the bushing 20. The bolt 30 is formed as an integral unit in a preferred embodiment of the present invention, and may be formed of steel, iron, or other appropriate material. Immediately adjacent the projecting end 32 of the bolt 30, and coaxial therewith, is a circular flange 35 which constitutes an enlarged diameter portion 36 of the bolt 30. Extending from the enlarged diameter portion 36 to the left as viewed in FIG. 2, is a main body portion 38 of the bolt 30. Formed around the circumference of the main body portion 38 there are two spaced apart peripheral grooves 40, 42. The peripheral grooves 40, 42 serve as recesses in the main body portion 38 of the bolt 30 for alternately receiving an engaging member, as will be further described herein.

The bolt 30 terminates with a handle 39 for grasping the bolt at an end opposite the projecting end 32. The handle 39 in the embodiment shown is a generally cylindrical extension of the main body portion 38 and is integral therewith. While the bolt 30 is illustrated as having a cylindrical cross section, this is not required by the present invention and other shapes such as a rectangular cross sectional bar or a flat bar may be used.

A third transverse flange 44 extends outwardly from the first prefabricated panel 12 and serve as a means for mounting a bolt support member 46 to the panel 12. The mounting of the bolt support member 46 to the panel 12 is accomplished by using threaded fasteners such as nuts 48 and bolts 49 passing through holes 52, 54 formed through the third transverse flange and the base 43 of the bolt support member 46. Alternatively, the bolt support member 46 may be attached to the panel 12 by welding or the like. An additional hole 51 is provided in the flange 44 to allow passage therethrough of the bolt 30.

The bolt support member 46 includes a base 43 with a support body 47 fixedly attached thereto. The support body has a first hollow passage 56 formed therethrough for slidably receiving the bolt 30. The support body 47 also has a second hollow passage 57 formed therethrough, the second hollow passage 57 being substantially transverse to the first hollow passage 56 and communicating with the first hollow passage 56. The bolt support member 46 also includes an engaging member 58 disposed within the second hollow passage 57. In the embodiment shown, the enaging member 58 is spherical body, but may also be ovoid or other appropriate shape. A coil spring 60 is disposed within the second hollow passage 57 and serves as a means for biasing the engaging member 58 toward the first passage 56, and the spring 60 biases the engaging member 58 against the bolt 30 when the bolt 30 is disposed within the first hollow passage 56. At least the outer portion of the second hollow passage 57 has threads formed on the inner walls thereof, and a threaded fastener such as a set screw 62 may be enaged in the internal threads of the second hollow passage 57 to serve as a means for preventing passage of the engaging member 58 and the spring 60 outwardly from the second passage 57 in a direction away from the first passage 56.

Due to the force exerted by the spring 60, the bolt 30 is disengagably held in position whenever the engaging member 58 is lined up withe either of the recesses 40, 42 formed in the bolt 30. This overcomes the deficiencies in the prior art of requiring time consuming processes to temporarily lock the bolt 30 in a retracted position. When the bolt 30 is moved into a retracted position, the recess 42 lines up with the engaging member 58 and the spring 60 pushes the engaging member 58 into the recess 42, thus holding the botl 30 in the retracted position until sufficient force is applied to the end of the bolt 30 opposite the projecting end 32 when the panel 12 is aligned with a second panel. Likewise, when the bolt 30 is passed through the apertures 18, 24 and the rececess 40 is lined up with the engaging member 58, the engaging member is biased into the recess 40 to hold the bolt 30 in position for the wedge 50 to be inserted into the slot 34.

A wedge 50 is provided for insertion into the slot 34 in the bolt 30 when the bolt 30 is inserted through the passages 18, 24 of flanges 16, 22 respectively to retain the panels 12, 14 in an aligned configuration. as illustrated in FIG. 1, the wedge 50 in one embodiment may be attached to the bolt 30 by attaching means 51 which may be a chain, a wire, a cord, or the like to prevent loss of the wedge 50 at a work site if it is dropped by a worker.

Although the present invention has been described herein with respect to specific embodiments thereof, it will be understood that the foregoing description is intended to be illustrative, and not restrictive. Many modifications of the present invention will occur to those skilled in the art. All such modifications which fall within the scope of the appended claims are intended to be within the scope and spirit of the present invention.

Having, thus, described the invention, what is claimed is:

1. A bolt and wedge assembly for connecting a first prefabricated panel to a second prefabricated panel wherein the first prefabricated panel has a first flange extending outwardly therefrom with a first aperture formed therethrough, and the second panel has a second flange extending outwardly therefrom with a second aperture formed therethrough which is alignable with the first aperture, the assembly comprising:

(a) a bolt having a projecting end with a transverse slot formed therethrough, an intermediate enlarged diameter portion adjacent the projecting end for limiting translation of the bolt in the flanges, a main body portion extending from the intermediate portion and having at least two recesses formed therein for alternately receiving an engaging member;

(b) a bolt support member comprising;

(1) a support body having a first hollow passage formed therethrough for slidably receiving the bolt, the bolt support member being mountable on the first or second prefabricated panel, the support body having a second hollow passage formed therein which is substantially transverse to the first hollow passage and communicates therewith;

(2) an engaging member disposed in the second hollow passage and dimensioned to fit within either of the recesses of the main body portion;

(3) means for biasing the engaging member toward the first passage; and (4) means for preventing passage of the engaging member and the biasing means outwardly from the second passage in a direction away from the first passage; and (c) a wedge dimensioned to fit within the slot in the projecting end of the bolt.

2. The assembly of claim 1, wherein the bolt is generally cylindrical in shape and the recesses therein are formed as circumferential grooves around the main body portion thereof.

3. The assembly of claim 1, wherein the engaging member has a substantially spherical shape.

4. A bolt and wedge assembly for connecting a first prefabricated panel to a second prefabricated panel, wherein the first prefabricated panel has a first flange extending outwardly therefrom with a first aperture formed therethrough, and the second panel has a second flange extending outwardly therefrom with a second aperture formed therethrough which is alignable with the first aperture, the assembly comprising:

(a) a bolt having a projecting end with a transverse slot formed therethrough, an intermediate enlarge diameter portion adjacent the projecting end for limiting translation of the bolt in the flanges, a main body portion extending from the intermediate portion and having at least two recesses formed therein for alternately receiving an engaging member;

(b) a bolt support member comprising:

(1) a support body having a first hollow passage formed therethrough for slidably receiving the bolt, the bolt support member being mountable on the first or second prefabricated panel, the support body having a second hollow passage formed therein which is substantially transverse to the first hollow passage and communicates therewith;

(2) an engaging member disposed in the second hollow passage and dimensioned to fit within either of the recesses of the main body portion;

(3) means for biasing the engaging member toward the first passage; and (4) means for preventing passage of the engaging member and the biasing means outwardly from the second passage in a direction away from the first passage; and (c) a wedge dimensioned to fit within the slot in the end of the bolt; wherein the second passage has threads formed therein, the means for biasing is a coil spring, and the means for preventing passage comprises a threaded fastener engagable in the second passage.

5. The assembly of claim 1, further comprising means for connecting the wedge to the bolt.

6. A bolt and wedge assembly for connecting a first prefabricated panel to a second prefabricated panel, wherein the first prefabricated panes has a first flange extending outwardly therefrom with a first aperture formed therethrough, and the second panel has a second flange extending outwardly therefrom with a second aperture formed therethrough which is alignable with the first aperture, the assembly comprising:

(a) a bolt having a projecting end with a transverse slot formed therethrough, an intermediate enlarged diameter portion adjacent the projecting end for limiting translation thereof in the flanges, and a main body portion extending from the intermediate portion;

(b) a wedge dimensioned to fit within the slot in the projecting end of the bolt; and (c) a bolt support member comprising:

(1) a support body having a hollow passage formed therethrough for slidably receiving the main body portion of the bolt therein, the support body being mountable on the first or second prefabricated panel; and (2) means operatively connected to the support body for resisting slidable movement of the bolt in the support body, the movement resisting means operable to temporarily and disengagably fix the position of the bolt with respect to the support member without requiring the use of the wedge.

7. The assembly of claim 4, further comprising means for connecting the wedge of the bolt.

* * * * *

UNITED STATES PATENT OFFICE

CERTIFICATE OF CORRECTION

Patent No. 4,975,009 Dated December 4, 1990

Inventor(s) John T. Easton & Harry Harden

It is certified that error appears in the above-identified patent and that said Letters Patent is hereby corrected as shown below:

Column 1, line 12, after "support member" insert --which--.
Column 1, line 37, change "blot" to --bolt--.
Column 1, line 44, change "here" to --hereby--.
Column 2, line 41, change "from" to --form--.
Column 3, line 61, after "is" insert --a--.
Column 4, line 10, change "withe" to --with--.
Column 4, line 17, change "botl" to --bolt--.
Column 4, line 21, change "rececess" to --recess--.
Column 4, line 29, change "as" to --As--.
Column 5, line 32, change "enlarge" to --enlarged--.
Column 6, line 20, change "panes" to --panel--.

Signed and Sealed this

Twenty-first Day of April, 1992

*Attest:*

HARRY F. MANBECK, JR.

*Attesting Officer* *Commissioner of Patents and Trademarks*